United States Patent [19]

Fingerson

[11] Patent Number: 4,522,009

[45] Date of Patent: Jun. 11, 1985

[54] LOCK ROD SYSTEM FOR FLOORING GRATING AND METHOD FOR ASSEMBLING SAME

[76] Inventor: Conrad F. Fingerson, 604 Winona St., Chatfield, Minn. 55923

[21] Appl. No.: 458,034

[22] Filed: Jan. 14, 1983

[51] Int. Cl.[3] ..... E04C 2/22; E04C 2/42

[52] U.S. Cl. ..... 52/667; 52/177; 52/309.3; 156/65; 156/293

[58] Field of Search ..... 52/664, 665, 666, 667, 52/668, 177, 106, 309.1, 309.3; 156/65, 293

[56] References Cited

U.S. PATENT DOCUMENTS

| | | | |
|---|---|---|---|
| 344,242 | 6/1886 | Brown | 52/667 |
| 450678 | 4/1891 | Pauly, Jr. . | |
| 469,519 | 2/1892 | Hale | 52/667 |
| 469,520 | 2/1892 | Hale | 52/667 |
| 856,131 | 6/1907 | Canda . | |
| 2,073,896 | 3/1937 | Loetscher | 52/668 |
| 2,084,118 | 6/1937 | Zabriskie . | |
| 2,272,227 | 2/1942 | Thomas | 52/668 |
| 2,834,267 | 5/1958 | Beebe | 52/667 |
| 3,156,168 | 11/1964 | Nagin | 52/177 |
| 3,307,317 | 3/1967 | Lynn . | |
| 3,675,957 | 7/1972 | Lockliter et al. . | |
| 3,746,379 | 7/1973 | Sauer . | |
| 3,861,108 | 1/1975 | Hartman . | |
| 4,018,188 | 4/1977 | Burdette . | |
| 4,037,383 | 7/1977 | Diebold et al. . | |
| 4,151,694 | 5/1979 | Sriberg | 52/667 |
| 4,244,768 | 1/1981 | Wiechowski | 52/667 |
| 4,258,662 | 3/1981 | Schafer . | |

FOREIGN PATENT DOCUMENTS

| | | | |
|---|---|---|---|
| 128684 | 4/1928 | Switzerland | 52/667 |
| 1230192 | 4/1971 | United Kingdom | 52/667 |

*Primary Examiner*—John E. Murtagh

*Attorney, Agent, or Firm*—Merchant, Gould, Edell, Smith, Welter & Schmidt

[57] ABSTRACT

A flooring grating including a plurality of spaced I-beam support members (12) is disclosed. A plurality of interconnecting members (14) interconnect the I-beam support members (12) in a predetermined spaced, parallel relationship. Each of the interconnecting members (14) includes a central core member (16) and first and second outer spacer members (18) positioned in longitudinally extending channel-like portions (30) on opposite sides of the central core member (16). The top surface of the outer spacer members (18) is notched at intervals corresponding to the spacing between adjacent I-beam support members (12). The outer spacer members (18) are securedly attached to the central core member (16) by a suitable adhesive. The central core member (16) and the outer spacer members (18) cooperate as an integral unit to retain the I-beam support members (12) in a predetermined spaced relationship.

30 Claims, 9 Drawing Figures

LOCK ROD SYSTEM FOR FLOORING GRATING AND METHOD FOR ASSEMBLING SAME

BACKGROUND OF THE INVENTION

The present system relates generally to the art of flooring gratings. More particularly, the present invention relates to a flooring grating wherein the bearing members of the grating are retained in a predetermined-spaced relationship by interconnecting members including cooperating key rod members and lock rod members adhesively bonded together.

Flooring gratings have long found application in industrial and agricultural environments. They are typically utilized where traction and wear resistance is necessary or where an elevated floor surface is needed for drainage space. Flooring gratings are commonly constructed of steel, aluminum alloys, or reinforced fiberglass. The flooring gratings generally comprise a series of parallel, elongated bearing members of various cross-sectional forms which are interconnected at generally regularly-spaced intervals with laterally extending cross-members. The flooring gratings are usually designed to be supported at the ends of the bearing members or at regularly spaced intervals so as to have a free span between the supports.

There are several methods currently utilized for securing the cross-members to the bearing members to provide a flooring grating having the required spacing of bearing members. In one method, the cross-members are positioned transversely between the bearing members through apertures adapted to receive the cross-members. Each of the cross-members is then suitably bonded to each of the bearing members at their respective junctions. However, in addition to other problems with this particular structure and method, assembly time is increased thereby raising manufacturing costs accordingly. Additionally, this type of grating often does not exhibit the structural integrity of mechanical spacers and is not able to withstand as much stress. Furthermore, should it be necessary to cut out various sections of the flooring grating, the flooring grating will disassemble unless the cross-members and bearing members are securedly attached at each and every junction. In addition, after the stress of extended use, the individual bonds may eventually break down wherein the grating will disassemble.

For example, U.S. Pat. No. 4,244,768 to Wiechowski et al. discloses a resin-bonded fiberglass grating wherein dowel rods are adhesively attached to elongated beams. The grating is assembled and then glue is applied on each of the dowel rods at the intersection of the dowel rods with the beams. In addition to other problems, some of which were discussed above, this disclosure requires that the adhesive or glue be applied after the grating is assembled at each of the dowel rod and beam intersections and that then the adhesive be heated. In metal gratings, the bonding is often accomplished by spot welding techniques.

An example of the use of mechanical spacers is U.S. Pat. No. 4,037,383 to Diebold et al. which discloses a metal grating having a plurality of parallel bearing members and cross-members passing laterally through longitudinally spaced holes in the bearing members. Separate spacer members are provided for maintaining the spacing between adjacent pairs of bearing members. The spacer members are held in place by compressing the bearing members and the spacer members. This is accomplished by the use of self-tapping screws cooperating with the outer bearing members and cross members. In addition to other problems, if a portion of the assembled flooring grating, including the self-tapping screws, is cut away, the flooring grating will disassemble as the spacer members are no longer retained in position.

In U.S. Pat. No. 469,519 to Hale, a metallic jail grating is disclosed utilizing a key bar and lock bar combination to retain the vertical jail bars in a predetermined spaced relationship. However, in addition to other problems, the key bar and the lock bars are not bonded together. The terminal ends of the key bar and lock bar combination are secured in a suitable manner to the side of the grating or the walls of the jail cell. Accordingly, if a section of the grating were cut away near the side of the grating, the grating might disassemble.

The present invention solves these and many other problems associated with currently available flooring gratings.

SUMMARY OF THE INVENTION

The present invention relates to a flooring grating. The grating includes a plurality of spaced bearing members each including a base portion, a vertical web portion, and an upper flange portion. Spacer means are utilized to interconnect the bearing members, the spacer means extending through apertures defined in the vertical web portions of the bearing members. Each of the spacer means includes a central core member and first and second outer spacer members positioned in longitudinally extending channel-like portions on opposite sides of the central core member. The outer surface of the outer spacer members is notched at intervals corresponding to the spacing between adjacent bearing members. The outer spacer members are securedly attached to the central core by a suitable adhesive, the central core member cooperating with the outer spacer members to retain the bearing members at a pedetermined spacing.

Furthermore, the present invention relates to a method of manufacturing a flooring grating. The method includes the steps of positioning elongated flooring members in a jig assembly. Elongated spacer elements are notched along a top surface thereof at predetermined intervals corresponding to the spacing required between the individual flooring members. Adhesive, under a slight amount of pressure, is applied in the notches and along the bottom surface of the elongated spacers. Two of the elongated spacer elements are inserted through each set of aligned apertures previously formed in the flooring members such that the spacer elements extend transversely of the flooring members. The spacer elements are positioned on opposite sides of the apertures such that the notches engage the flooring members at the periphery of the apertures. Adhesive is applied under slight pressure to central core members. One central core member is then slid between each of the two spacer elements generally the length of the spacer elements.

Accordingly, one of the features of the present invention is the provision of a flooring grating which does not disassemble or fall apart when it is necessary to cut away portions of the flooring grating so as to install the flooring grating around various obstructions or the like.

Yet another feature of the present invention, is the provision of a flooring grating which is relatively easy and inexpensive to manufacture.

Another feature of the present invention is the provision of a flooring grating utilizing both mechanical spacing means and adhesive bonding to provide a flooring grating with substantial structural integrity and the ability to withstand the stress of extended use.

Yet another feature of the present invention is the provision of a flooring grating which is structurally rigid and minimizes relative movement between the respective members.

Another feature of the present invention is the provision of multi-element mechanical spacing means extending between adjacent flooring members. The elements of the interconnecting means are bonded together such that the elements function as an integral unit thereby increasing the rigidity of the flooring structure. This reduces the relative movement between the flooring members and the interconnecting means thereby reducing the likelihood that the flooring will disassemble through extended use.

Another feature of the present invention is the provision of a mechanical lock rod and key rod combination which in cooperation with adhesive bonding, retains the flooring members in a predetermined spaced relationship. Furthermore, the lock rod and key rod combination is easily assembled thereby simplifying the manufacturing process and reducing manufacturing costs.

In one embodiment of the present invention, a flexible adhesive is applied continuously along diametrically opposed channel-like portions of a central core member. In addition, adhesive in yet another embodiment of the present invention is also applied continuously along a bottom surface of spacer members which lie adjacent the channel-like portions of the central core member. Accordingly, adhesive is evenly dispersed along the entire length of the spacer members and central core member.

Yet another feature of the present invention, is the use of a flexible adhesive which has suitable viscosity to assure adequate flowing or dispersement of the adhesive. In addition, the flexible adhesive reduces the likelihood that the adhesive bands will break due to any movement resulting from forces exerted on the flooring. Furthermore, the flexible adhesive results in a significant noise reduction.

In yet another embodiment of the present invention, an adhesive displaying thixotropic properties is utilized. When disturbed or exposed to a slight amount of pressure, the adhesive will behave as a fluid and display required flow characteristics so as to be adequately dispersed into the interstices between adjacent surfaces thereby securedly bonding the various elements of the flooring grating. However, when not so disturbed and when under normal pressure, the adhesive will not flow, such that once applied by a suitable die structure under slight pressure, the adhesive will remain in position until again disturbed. This enables controlled application of the adhesive during the manufacturing process which results in a reliable structure and a relatively clean manufacturing process.

In yet another embodiment of the present invention, yet another feature is the use of an adhesive which will cure or set at room temperature.

In yet another embodiment of the present invention, one end of the central core member is tapered to provide a substantially wedge-shaped end portion. In yet another embodiment of the present invention, one end of the spacer members has a bottom surface adjacent the channel-like portions of the central core member which diverges generally away from the channel-like portion in a direction toward the end of the spacer members. The tapered end portion of the central core member and the diverging end portions of the spacer members cooperate to assure that the flexible adhesive is continuously dispersed along the surfaces thereof and not wiped away when the central core member is slid between the two spacer elements. As the wedge-shaped end portion of the central core member is inserted in between the spacer members, the adhesive is disturbed and is caused to flow between the central core member and the spacer members. The flexible adhesive creates a slight pressure between the adjacent surfaces which has a tendency to force the spacer members away from the central core member. In addition, the adhesive aids in lubricating the central core member such that the central core member is easily inserted between the two spacer members.

In yet another embodiment of the present invention, the spacer members provide support for the upper flange portion of the bearing members, thereby aiding in preventing the flange portions from being broken.

In yet another embodiment of the present invention, the central core member and cooperating spacer members are inserted through cylindrical apertures in the vertical web portion of the flooring members. The cylindrical apertures are more easily formed than are rectangular apertures.

In yet another embodiment of the present invention, the side surfaces of the central core member have the same radius of curvature as the cylindrical apertures in the flooring members thereby enabling the central core member to substantially fill in the cylindrical apertures.

In yet another embodiment of the present invention, the spacer members have top surfaces with a radius of curvature substantially that of the cylindrical apertures. This enables the spacer members to have a relatively large girth and still be insertable through the cylindrical apertures, thereby enabling deeper notches to be made therein. Furthermore, the larger girth increases the overall area of contact between the spacer elements and the web portion of the flooring members. Additionally, the curvilinear top surface facilitates insertion of the spacer members through the cylindrical apertures.

In yet another embodiment of the present invention, relatively flat notches are made in the top surface of the spacer members to provide a gap between the periphery of the cylindrical aperture and the notches for receipt of the flexible adhesive. In yet another embodiment of the present invention, the ends of the spacer members are tapered to aid in the insertion of the spacer members through the cylindrical apertures in the flooring support members.

The above described features and advantages along with various other advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views.

DETAILED DESCRIPTION OF A PREFERRED EMBODIMENT OF THE PRESENT INVENTION

Figure 1:
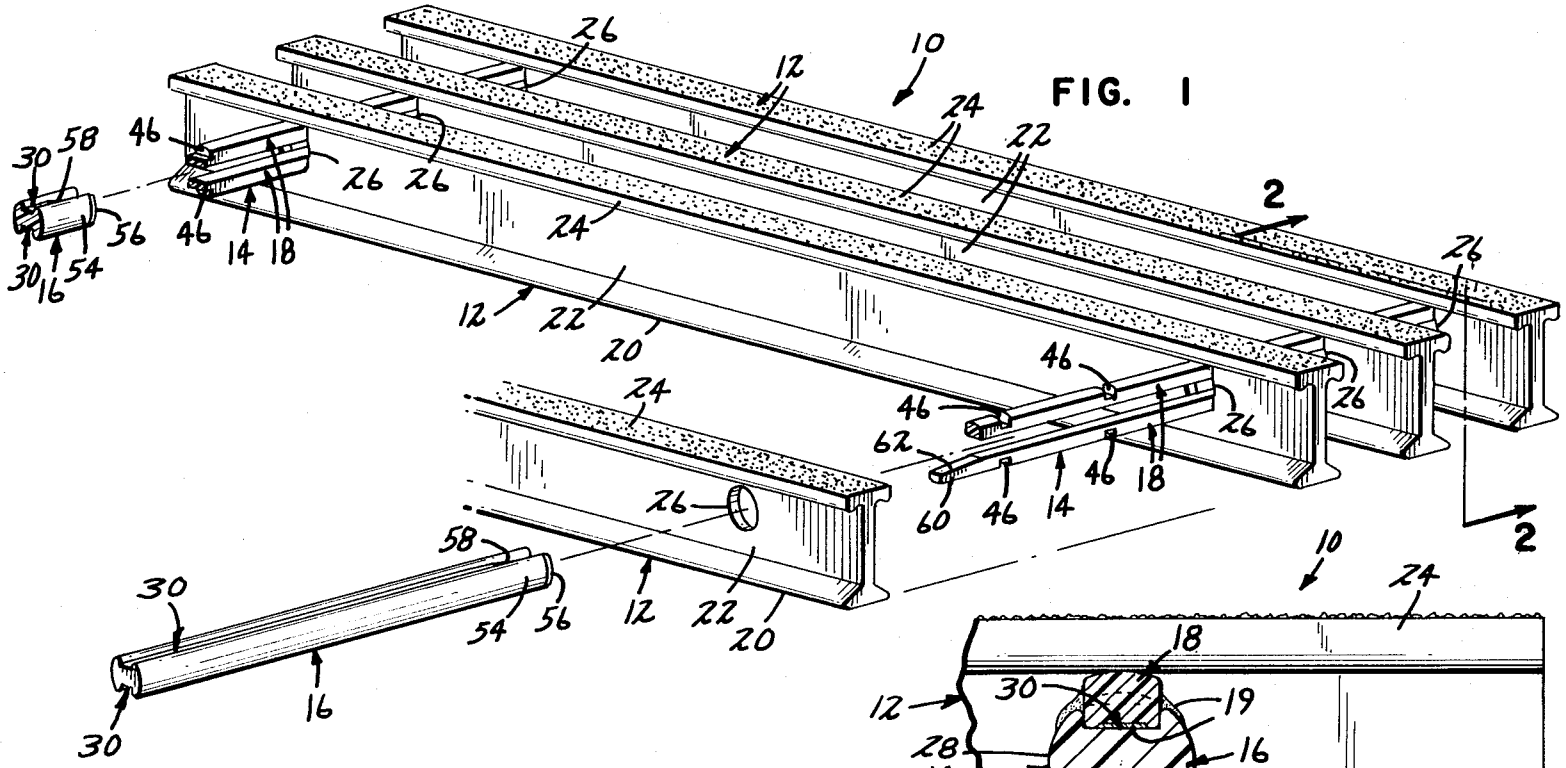
FIG. 1 is a view in perspective, partially exploded, of a portion of a preferred embodiment of the flooring grating of the present invention.
Figure 2:
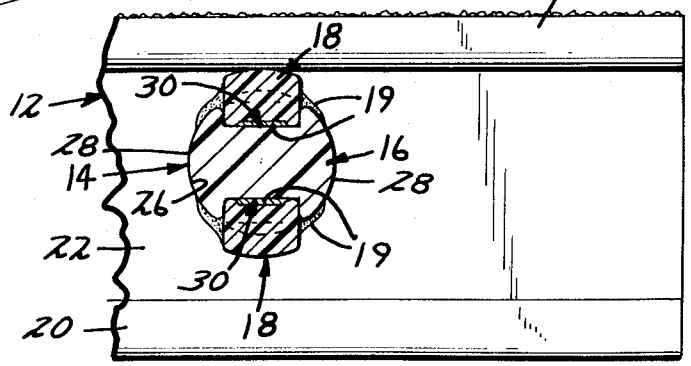
FIG. 2 is an enlarged cross-sectional view generally along line 2—2 in FIG. 1.
Figure 3:
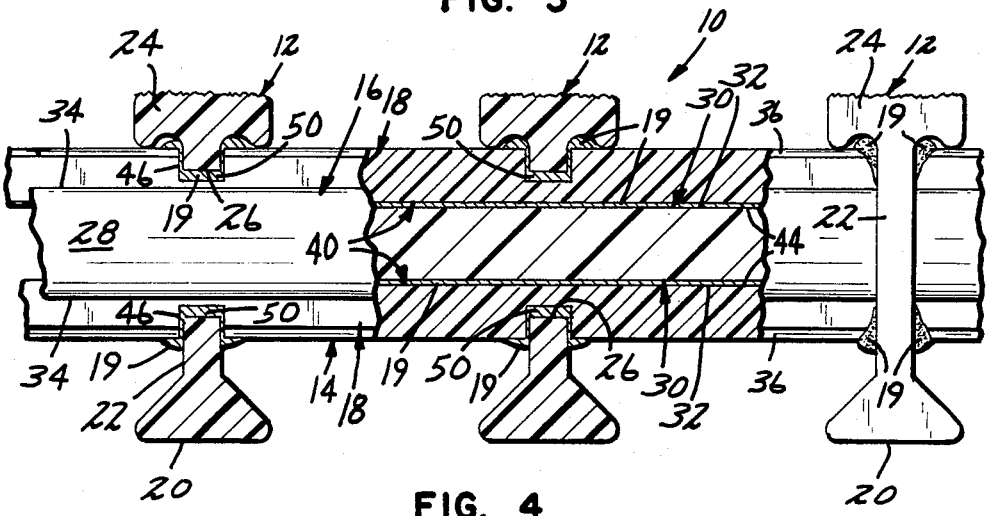
FIG. 3 is a fragmentary side elevational view of the embodiment shown in FIG. 1, portions thereof broken away and shown in cross-section.

Illustrated in FIG. 1 is a preferred embodiment of a flooring grating of the present invention which is generally designated by the reference numeral 10. The flooring grating 10 of the present invention includes a plurality of spaced, generally parallel flooring members 12 also referred to as support members or bearing members. The flooring members 12 are connected together in a grating construction by a plurality of interconnecting structures 14. The interconnecting structures 14 include a central core member 16, or key rod adhesively bonded to two outer spacer members 18, or lock rods, by a suitable, flexible adhesive 19 as illustrated in FIGS. 2 and 3. It will be appreciated that while the preferred embodiment is illustrated as utilizing two spacer members 18, in alternate embodiments, one or more spacer members 18 might be utilized. In addition, while the spacer members 18 are illustrated as being generally in vertical alignment, it will be appreciated that the spacer members 18 might have other orientations about the central core member 16; for example, the spacer members 18 might be aligned horizontally.

More particularly, the flooring members 12 include a base portion 20, a web portion 22 and an upper flange portion 24. Each of the flooring members 12 has a plurality of apertures 26 extending transversely therethrough. In the preferred embodiment, the apertures 26 are generally cylindrical in configuration.

The flooring members 12 may have various cross-sectional configurations such as rectangular, square, L-shaped, T-shaped, etc., but as illustrated in the preferred embodiment, the flooring members 12 have the general configuration of an "I" and, for that reason, may be frequently referred to as I-beam members. However, it will be appreciated that the present invention is applicable to many forms of flooring members 12, and in particular T-shaped members as they will typically have an extended upper flange portion.

Each of the interconnecting structures 14 extends through sets of the apertures 26 in the web portion 22 of the flooring members 12 which are in relative alignment.

The upper surface of the upper flange portions 24 may be planar or as illustrated in FIG. 3, may be roughened or coated with another material so as to provide an increased gripping surface for the flooring grating.

Figure 5:
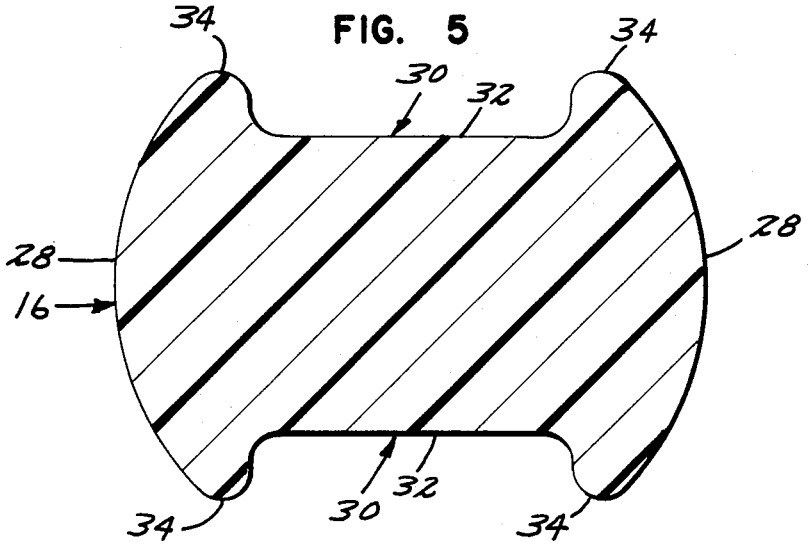
FIG. 5 is a transverse cross-sectional view of the central core member of the preferred embodiment.

As illustrated in FIGS. 2 and 5, the central core member 16 defines two side surfaces 28 which have a radius of curvature substantially the same as that of the apertures 26. In addition, the center core member 16 defines two diametrically opposed channel-like portions 30. The channel-like portions 30 define a relatively flat bearing surface 32 recessed between two generally vertically extending guide portions 34. The channel-like portions 30 are configured to slidingly receive the outer spacer members 18.

Figure 4:
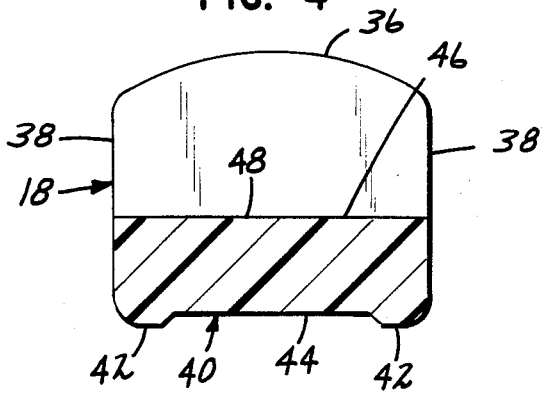
FIG. 4 is a view in transverse cross-section of the spacer members of the preferred embodiment.

As illustrated in FIGS. 2 and 4, the outer spacer members 18 define a curvilinear top surface 36 facing away from the central core member 16, two side surfaces 38 and a bottom surface 40 adjacent the central core member 16. The bottom surface 40 of the outer spacer members 18 define two spaced apart ridged portions 42 which extend generally longitudinally along the edges of the spacer members 18. A recessed central surface portion 44 is positioned between the two ridged portions 42. As illustrated in FIG. 2, the raised ridge portions 42 lift the recessed central surface portion 44 above the relatively flat bearing surface 32 of the central core member 16 so as to define a space therebetween.

As further illustrated in FIGS. 1 and 4, the spacer members 18 have notches 46 defined in the top surface 36 thereof at predetermined intervals corresponding to the spacing between the flooring members 12. As illustrated in FIG. 4, in the preferred embodiment the notches define a relatively flat surface 48. Accordingly, when the spacer members 18 are positioned transversely of the flooring members 12 such that the notches 46 engage the web portion 22 surrounding the apertures 26, a space 50 is defined between the flat surface of the notches 46 and the web portion 22 at the periphery of the apertures 46.

Additionally, in the preferred embodiment of the spacer members 18, the top surface has a radius of curvature substantially the same as that of the aperture 26 thereby enabling spacer members 18 of relatively large girth to be inserted through the cylindrical apertures.

Preferably, the flooring members 12 and the interconnecting members 14 are made from a reinforced fiberglass. The flooring members 12 might be made of both mat and unidirectional fibers while the interconnecting members 14 are preferably made from unidirectional fibers.

The flooring grating 10 of the present invention is assembled by positioning a predetermined number of the flooring members 10 in a suitable jig structure. The number of flooring members 12 selected, will depend on the size of the grating section to be manufactured and the relative spacing between the individual flooring members 12. The cylindrical apertures 26 are typically drilled in the flooring member before insertion in the jig structure. The drilling of apertures in the reinforced fiberglass material of the flooring members 12 is much preferred over rectangular apertures which are typically formed by a punch process.

Once the flooring members 12 are positioned in the jig structure, the outer spacer members 18 are inserted through the apertures 26. Prior to insertion, the adhesive 19 is placed continuously along the bottom surface 40. This might be accomplished by utilizing a suitable die to apply the adhesive 19 along the bottom surface 40 under slight pressure. In addition, the top surface 36 is notched at the intervals corresponding to the spacing between the flooring members 12. The flexible adhesive 19 is also placed in the notches 46 by suitable die structure under a slight amount of pressure. This might be accomplished at the same time the adhesive 19 is applied to the bottom surface 40.

Figure 6:
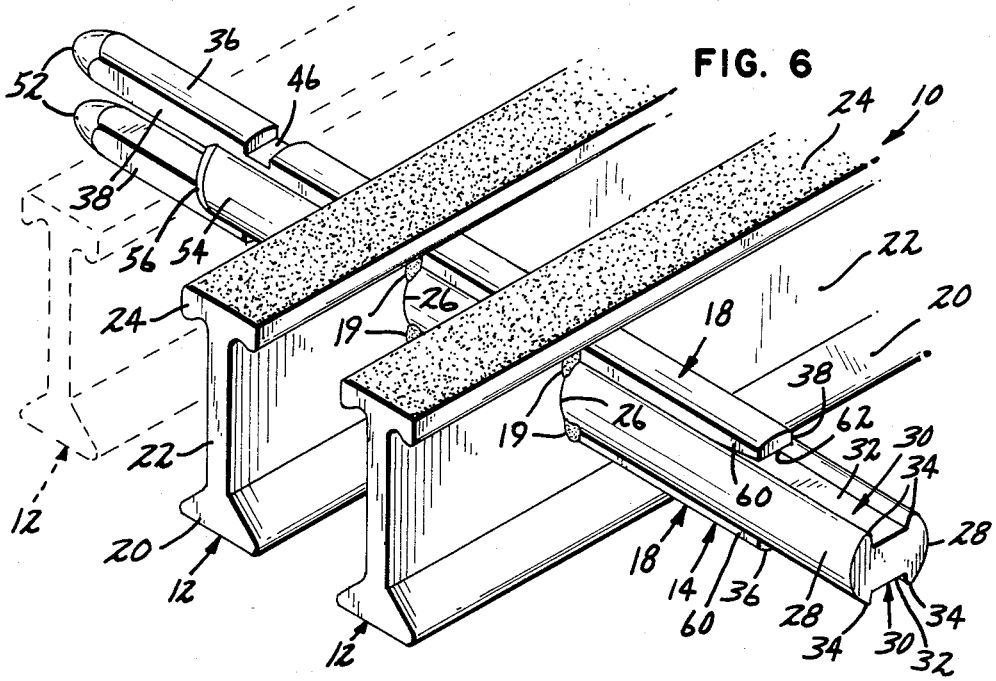
FIG. 6 is a fragmentary perspective view of the preferred embodiment of the present invention being assembled.

The spacer members 18 are positioned at opposite sides of the apertures 26 such that, in the preferred embodiment, as illustrated in FIG. 3, a portion of the top surface 36 of one of the spacer members 18 engages the upper flange portion 24 of the flooring members 12. The adhesive 19 is then applied along the relatively flat bearing surface 32 of the central core member 16. This might also be accomplished by utilizing a suitable die structure for applying the adhesive under a slight amount of pressure. The central core member is then inserted through the apertures 26 between the spacer members 18 as generally illustrated in FIG. 6 such that the bottom surface 40 of the spacer members 18 slides in the channel-like portions 30 of the central core member 16. As illustrated in FIGS. 2 and 3, the adhesive 19 will flow into the interstices between adjacent surfaces and partially about the periphery of the apertures 26 to further ensure a good adhesive bond to the flooring members 12.

Preferably, as illustrated, a leading end 52 of the spacer members 18 is pointed to facilitate insertion of the spacer members 18. In addition, the side surfaces 28 of a leading end 54 of the central core member 16 are slightly radiused along a portion 56 to facilitate ease of insertion.

Figure 7:
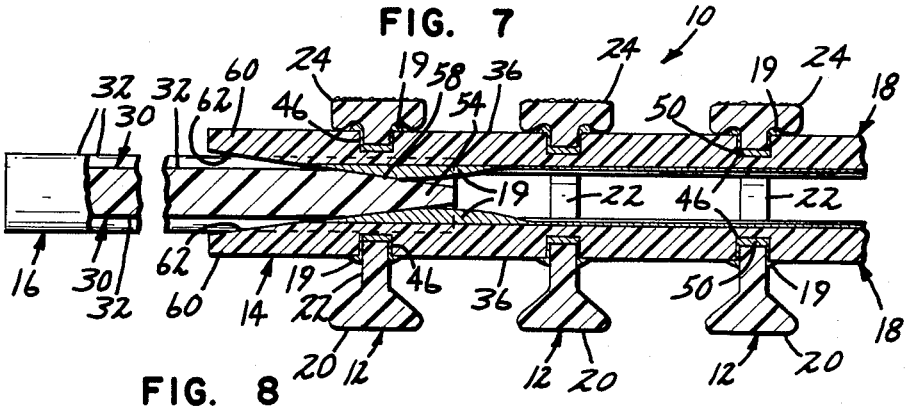
FIG. 7 is a partial cross-sectional view of the central core member partially inserted between the spacer members.
Figure 8:
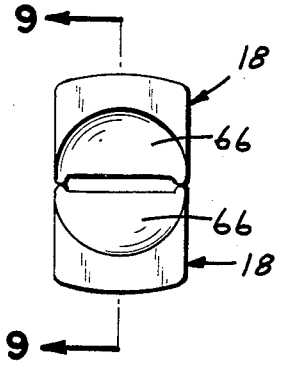
FIG. 8 is an end elevational view of yet another embodiment of a tapered end portion of the spacer members; and, FIG. 9 is an enlarged cross-sectional view as seen generally along line 9—9 in FIG. 8.
Figure 9:
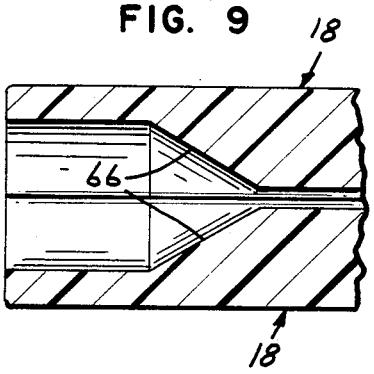

In addition, as illustrated in the preferred embodiment shown in FIG. 7, the relatively flat bearing surfaces 32 of the central core member 16 at the leading end 54 are tapered or inclined toward each other to define a generally wedge-shaped end portion 58. Furthermore, a portion 62 of the bottom surface 40 near a trailing end 60 of the outer spacer members 18 is tapered so as to be generally diverging away from the relatively flat bearing surface 32 of the central core member 16 in a direction toward the trailing end 60.

As illustrated in FIG. 7, the wedge-shaped end portion 58 at the leading end 54 of the central core member 16 cooperates with the tapered surface portion 62 at the trailing end 60 of the outer spacer members 18 to assure that the adhesive is not wiped away as the central core member 16 is inserted between the spacer members 18, thereby assuring the adhesive is evenly dispersed along the entire length of the central core member 16 and outer spacer members 18. This assures that there will be a continuous, somewhat uniform layer of the adhesive 19 between the adjacent surfaces of the central core member 16 and the spacer members 18. In addition, the adhesive will function to lubricate the central core member 16 as it is moved along the spacer members 18 thereby facilitating its insertion.

The preferred embodment of the present invention utilizes an adhesive displaying thixotropic properties. Accordingly, when the adhesive is disturbed or exposed to a slight amount of pressure, the adhesive will act as a fluid displaying required flow characteristics to insure that the adhesive will adequately fill in the interstices and is evenly dispersed on the surface areas where applied. However, when not disturbed and under normal pressure, the adhesive will not flow, thereby assuring that the adhesive will remain in the interstices and on the surfaces where previously applied. This provides for controlled application of the adhesive and makes for a relatively clean manufacturing process.

During assembly, when the spacer members 18 are properly positioned in the cylindrical apertures 26, the pressure exerted on the adhesive 19 in the notches 46, causes the adhesive to flow and to completely fill in the interstices between the spacer members 18 and the flooring members 12. Furthermore, as illustrated in FIG. 2, the adhesive 19 will even flow partially around the central core member 16. In addition, when the central core member 16 is inserted between the spacer members 18, the wedge-shaped end portion 58 of the central core member 16 and the tapered surface portion 62 of the spacer members 18, will disturb the thixotropic adhesive 19 so as to subject the adhesive to a slight pressure. Consequently, the adhesive 19 will act like a fluid and is caused to flow between the spacer members 18 and the central core member 16 due to the overall configuration thereof. Furthermore, the adhesive 19 will aid in forcing the spacer members 18 away from the central core member 16 to facilitate insertion of the central core member 16 between the spacer members 18 and insure even dispersal of the adhesive 19.

In the preferred embodment, a flexible epoxy adhesive made by the 3M Corporation and referred to as SCOTCH-WELD structural adhesive 2216 B/A is utilized (SCOTCH-WELD is a trademark of the 3M Corporation). This particular product is a two-part epoxy mixture including an epoxy resin or base with a viscosity of 100,000 centipoise and a curing agent or accelerator which is a modified amine with a viscosity of 52,000 centipoise. The base and accelerator are mixed together to provide a mixture of five parts base to seven parts accelerator by weight. The completed mixture has a viscosity of approximately 75,000 centipoise. A flexible adhesive such as 2216 provides several advantages not the least of which is that it is very flexible in the cured state and can withstand a great deal of deflection before failure. In addition, 2216, with appropriate additives such as Fumed Silica, displays the required thixotropic properties in that it will readily flow under slight pressure or when disturbed at room temperature to fill in interstices or cavities as required. (Fumed Silica is available from the Cab-O-Sil Division of the Cabot Corporation in Tuscola, Ill. under the trademark of CABOSIL). In the preferred embodiment, CABOSIL is added to the adhesive 2216 to create a mixture which is one-quarter percent to three percent CABOSIL by weight. The viscosity of the resultant mixture increases significantly when the CABOSIL is added. It will be appreciated, that other suitable flexible epoxy adhesives may be utilized in conjunction with various additives to provide an adhesive with the required thixotropic properties.

Preferably, the adhesive is applied under slight pressure to the flat bearing surfaces 32 of the central core member 16 and the bottom surface 40 of the outer spacer members 18 at a thickness of approximately 2 to 15 mil, more preferably 5 to 10 mil, and most preferably 8 mils.

The present invention thus provides for a grating assembly wherein the individual flooring members are held together by both a mechanical lock and key rod assembly and an adhesive bonding. The adhesive, is applied along the entire length of the lock and key rod member to assure that the flooring grating will not disassemble if it is necessary to cut away or remove portions thereof during installation. In addition, the mechanical spacer system and adhesive cooperate to provide a very strng and rigid flooring structure which is relatively easy to assemble and assures that the flooring will not disassemble or that the structural integrity of the flooring grating will not be impaired by cutting away sections of the flooring during installation.

In addition, the central core member 16 and outer spacer members 18 cooperate to function as an integral interconnecting assembly as they are adhesively bonded to one another thereby providing the flooring grating with increased rigidity. In addition, the configuration of the central core member 16 and the spacer members 18 assures that a continuous layer of adhesive will be present between the adjacent surfaces of the central core member 16 and the spacer members 18.

Furthermore, the present invention provides a flooring grating which reduces the relative movement between the flooring members 12 and the interconnecting members 14. In addition, the flexible adhesive utilized substantially reduces the noise created by normal use and provides for somewhat resilient adhesive bonds which will not break even should there be relative movement between the flooring members 12 and the interconnecting members 14 due to excessive forces.

It should be understood, however, that even though these numerous characteristics and advantages of the invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A fiber reinforced plastic flooring grating, comprising:

(a) a plurality of spaced support members;

(b) spacer means for interconnecting said support members, said spacer means extending through aligned apertures defined in said support members, said spacer means including first and second members having a longitudinal extent, said second member being notched at intervals corresponding to the spacing between adjacent support members, the notches being adapted to engage said support members, said first and second members being securedly attached to one another by a substantially continuous layer of adhesive dispensed along the longitudinal extent of said first and second members, said first and second members cooperating to retain said support members at a predetermined spacing.

2. A flooring grating in accordance with claim 1, wherein one of said members makes contact with a flange portion of said support members so as to provide vertical support therefor.

3. A flooring grating in accordance with claim 1, wherein said first member includes a channel-like portion defining a recessed relatively flat bearing surface positioned beteen projecting guide portions, said channel-like portion being adapted for receipt of said second member.

4. A flooring grating in accordance with claim 3, wherein a bottom surface of said second member adjacent said first member defines two spaced apart, raised ridge portions extending longitudinally along the edges of said second member, said ridge portions making contact with said relatively flat bearing surface of said first member to raise a central surface portion of said bottom surface lying between said ridge portions above said relatively flat bearing surface of said first member.

5. A flooring grating in accordance with claim 1, wherein said support members and said first and second members are made from a fiberglass reinforced material.

6. A flooring grating in accordance with claim 1, wherein said second member has a top surface which is generally curvilinear.

7. A flooring grating in accordance with claim 1, wherein side surfaces of said first member are curvilinear.

8. A flooring grating in accordance with claim 1, wherein the apertures defined in said support members are generally cylindrical.

9. A flooring grating in accordance with claim 1, wherein adhesive is placed in the notches defined by said second member, said second member being securedly attached to said spaced support members by said adhesive positioned in the notches.

10. A flooring grating in accordance with claim 1, wherein said first member includes a tapered end portion.

11. An apparatus for holding a plurality of flooring slats in a predetermined, spaced relationship, said apparatus comprising:

a plurality of elongated fiber reinforced plastic interconnecting elements extending transversely of the individual flooring slats, said interconnecting elements extending through aligned apertures in the flooring slats, each of said interconnecting elements including a central core member and a spacer member having a longitudinal extent, said central core member defining a channel structure, said channel structure extending longitudinally of said central core member, said channel structure being adapted for receipt of said spacer member, said spacer member being notched at predetermined intervals which correspond to the spacing of the flooring slats, the notches being adapted to engage the flooring slats said spacer member being fixedly secured to said central core member by a substantially continuous layer of adhesive disposed along the longitudinal extent of said central core member and said spacer member, said central core member having rounded side walls thereby enabling a cylindrical aperture to be utilized in said flooring slats.

12. An apparatus in accordance with claim 11, wherein an adhesive generally displaying thixotropic properties is utilized.

13. A method of making a fiber reinforced plastic floor grating assembly comprising the steps of:

(a) positioning elongated flooring members in jig assembly means for holding said elongated flooring members;

(b) applying adhesive in the notches of elongated spacer elements previously notched at intervals corresponding to the spacing required between the flooring members;

(c) inserting two of said elongated spacer elements through a set of aligned apertures previously formed in said flooring members such that said spacer elements extend transversely of said flooring members;

(d) positioning said spacer elements on opposite sides of said apertures such that said notches engage said flooring members at the periphery of said apertures;

(e) applying adhesive continuously along central core members on diametrically opposed sides thereof; and (f) sliding one of said central core members between each of said two spacer elements generally the length of said spacer elements such that the diametrically opposed sides having adhesive thereon are adjacent to said spacer elements.

14. The method in accordance with claim 13, further including the step of applying adhesive continuously along the length of said elongated spacer elements on the surface thereof adjacent said central core member prior to the step of inserting the elongated spacer elements through the aligned apertures in said flooring members.

15. The method in accordance with claim 13, further including the step of tapering one of the ends of said central core members to form a generally wedge-shaped end portion.

16. The method in accordance with claim 13, further including the step of tapering one of the ends of each of said elongated spacer elements such that the surface of said elongated spacer elements adjacent said central core member diverges away from said central core member in a direction toward the end of said elongated spacer elements.

17. A fiber reinforced plastic grating structure, comprising:

(a) a plurality of spaced parallel bearing elements, said bearing elements defining a plurality of spaced apertures along the longitudinal extent of said bearing elements;

(b) interconnecting means for holding said bearing elements in a predetermined space relationship, said interconnecting means extending through respectively aligned apertures in said bearing elements;

(c) said interconnecting means including a key rod member provided with two diametrically opposed generally U-shaped, longitudinally extending grooves on the outer surface of said key rod member; and, (d) said interconnecting means further including two lock rod members adapted to slide in said grooves of said key rod member, said lock rod members being securedly connected to said key rod member by a substantially continuous layer of adhesive positioned between said key rod member and said lock rod members generally along the longitudinal extent thereof, said lock rod members defining generally a top surface facing away from said key rod member, two side surfaces, and a bottom surface facing said key rod member, said lock rod members defining notches in said top surface at predetermined intervals corresponding to the spacing between said bearing elements, the notches being adapted to engage the bearing elements, said lock rod members and said key rod member cooperating to increase the rigidity of said interconnecting means.

18. A grating structure in accordance with claim 17, wherein said lock rod members define a recess in said bottom surface.

19. A grating structure in accordance with claim 17, wherein one end of each of said lock rod members is tapered on the bottom surface thereof so as to define a bottom surface portion oblique with respect to said corresponding groove in said key rod member, said bottom surface portion diverging away from said corresponding groove in a direction toward the end of said lock rod members.

20. A grating structure in accordance with claim 19, wherein an opposite end of said lock rod members is somewhat pointed.

21. A grating structure in accordance with claim 17, wherein aid U-shaped grooves each define a relatively flat bearing surface and two side portions, said relatively flat bearing surfaces being tapered at one end of said key rod member toward each other to form a generally wedge-shaped portion.

22. A grating structure in accordance with claim 17, wherein the side walls of said key rod member have generally the same radius of curvature as said aperture in said bearing elements.

23. A grating structure in accordance with claim 17, wherein said top surfaces of said lock rod members have generally the same radius of curvature as said apertures in said bearing elements.

24. A grating structure in accordance with claim 17, wherein said securing means is an adhesive displaying thixotropic properties.

25. A fiber reinforced plastic flooring grating in accordance with claim 1, wherein said first and second members include cooperating surface means integral with said first and second members for providing a longitudinally extending space between said first and second members for receipt of the layer of adhesive when said first and second members are positioned in said apertures.

26. A fiber reinforced plastic flooring grating in accordance with claim 1, wherein a bottom surface of said second member adjacent the first member includes raised ridge means extending longitudinally along said second member for making contact with a relatively flat bearing surface of said first member so as to raise a portion of said bottom surface of said second member above said relatively flat bearing surface of said first member, whereby providing a longitudinally extending space between said first and second members for receipt of the layer of adhesive when said first and second members are positioned in said apertures.

27. A method of making a fiber reinforced plastic floor grating assembly comprising the steps of:

(a) positioning elongated flooring members in jig assembly means for holding said elongated flooring members, said elongated flooring members having sets of aligned apertures formed therein;

(b) inserting through each set of aligned apertures in elongated spacer element previously notched at intervals corresponding to the spacing between adjacent ones of the flooring members such that said spacer elements extend transversely of said flooring members;

(c) positioning said spacer elements such that said notches engage said flooring members to mechanically lock the flooring members in a predetermined spacial arrangement;

(d) inserting through each set of aligned apertures through which a spacer element has previously been inserted, an elongated central core member, said spacer element and said core member slidably engaging one another along adjacent, facing surfaces; and (e) applying adhesive continuously along the adjacent, facing surface of at least one of said central core members and said spacer elements prior to insertion thereof through said sets of aligned apertures.

28. A method in accordance with claim 27, including the step of applying adhesive along both of the adjacent facing surfaces of said first and second members.

29. A method in accordance with claim 27, including the step of inserting two of said spacer elements through each set of aligned apertures, said spacer elements being positioned along diametrically opposed sides of the first member.

30. A fiber reinforced plastic flooring grating, comprising:

(a) a plurality of spaced support members;

(b) spacer means for interconnecting said support members, said spacer means extending through aligned apertures having curvilinear edge surfaces defined in said support members, said spacer members including first and second members having a longitudinal extent, said second members being notched at intervals corresponding to the spacing between adjacent support members, the notches being adapted to engage said support members, said spacer means having a diameter nearly that of said apertures, said first and second members being securedly attached to one another by a substantially continuous layer of adhesive dispensed along the longitudinal extent of said first and second members, said first and second members further including cooperating facing surface means integral with said first and second members for providing a longitudinally extending space between said first and second members for receipt of the layer of adhesive when said first and second members are positioned in said apertures, said first and second members cooperating to retain said support members at a predetermined spacing.

* * * * *

UNITED STATES PATENT AND TRADEMARK OFFICE

CERTIFICATE OF CORRECTION

PATENT NO. : 4,522,009

DATED : June 11, 1985

INVENTOR(S) : Conrad F. Fingerson

It is certified that error appears in the above-identified patent and that said Letters Patent is hereby corrected as shown below:

Column 3, line 44, "bands" should be --bonds--;

Column 9, line 8, "strng" should be --strong--;

Column 12, line 16, "aid" should be --said--;

Column 12, line 59, "in" should be --an--.

Signed and Sealed this

*Twentieth* Day of *May 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,522,009

DATED : June 11, 1985

INVENTOR(S) : Conrad F. Fingerson

It is certified that error appears in the above-identified patent and that said Letters Patent is hereby corrected as shown below:

Column 3, line 44, "bands" should be --bonds--;

Column 9, line 8, "strng" should be --strong--;

Column 12, line 16, "aid" should be --said--;

Column 12, line 59, "in" should be --an--.

Signed and Sealed this

First Day of July 1986

[SEAL]

Attest:

DONALD J. QUIGG

Attesting Officer

Commissioner of Patents and Trademarks